US007819551B2

(12) United States Patent
Ward

(10) Patent No.: US 7,819,551 B2
(45) Date of Patent: Oct. 26, 2010

(54) LIGHT SOURCE MOUNTING SYSTEM AND METHOD

(75) Inventor: Pat Ward, San Antonio, TX (US)

(73) Assignee: Luciter Lighting Company, San Antonio, TX (US)

( * ) Notice: Subject to any disclaimer, the term of this patent is extended or adjusted under 35 U.S.C. 154(b) by 381 days.

(21) Appl. No.: 12/008,563

(22) Filed: Jan. 9, 2008

(65) Prior Publication Data

US 2008/0198598 A1 Aug. 21, 2008

Related U.S. Application Data

(60) Provisional application No. 60/879,511, filed on Jan. 9, 2007.

(51) Int. Cl.
*F21V 21/00* (2006.01)

(52) U.S. Cl. ..... 362/249.01; 362/240; 362/249.02; 362/294; 362/373; 362/800

(58) Field of Classification Search ..... 362/240, 362/249.01–249.02, 294, 373, 800
See application file for complete search history.

(56) References Cited

U.S. PATENT DOCUMENTS 6,367,949 B1 * 4/2002 Pederson ..... 362/240
2007/0165410 A1 * 7/2007 Rochfort ..... 362/328

* cited by examiner

*Primary Examiner*—Sandra L O'Shea
*Assistant Examiner*—Meghan K Dunwiddie

(57) ABSTRACT

A mounting system and method for a light source includes a light source support structure. The light source support structure positions the light source with respect to a source of electrical power which, when connected to the light source, will cause the light source to emit light energy. Further included in the mounting system and method of present invention is a mounting for a pair of electrical contacts which enable connection between the source of electrical power and the light source. Still further included in mounting system is a heat sink which is attachable to the light source support structure for conducting heat energy away from the light source.

3 Claims, 6 Drawing Sheets

LIGHT SOURCE MOUNTING SYSTEM AND METHOD

CROSS REFERENCE TO RELATION APPLICATION

This application claims the benefit of Provisional U.S. Patent Application No. 60/879,511 filed Jan. 9, 2007.

STATEMENT REGARDING FEDERALLY FUNDED RESEARCH AND DEVELOPMENT

The invention described in this patent application was not the subject of federally sponsored research or development.

FIELD

The present invention pertains to light source mounting systems; more particularly the present invention pertains to a mounting system for a light source usable in place of prior art light sources. While the present invention is described with regard to its use as a replacement for a festoon style bulb, those of ordinary skill in the art will understand that the system and method of the present invention enables the replacement of other types of prior art light sources.

BACKGROUND

In commercial lighting applications, particularly to illuminate products in display cases, and many direct and indirect lighting applications such as under-shelf lighting or cove lighting, a series of festoon style bulbs are arranged in a linear or arcuate array with respect to one another. The advantage provided by the linear array of festoon style bulbs is that the pattern of illumination provided is spread out in a substantially uniform manner over a predetermined distance.

As shown in FIG. 1, prior art incandescent festoon style bulbs 101 have a central elongated translucent tube with electrically conductive caps or wire loops located on either end. Strung between the electrically conductive caps or wire loops is an elongated filament which produces light when the caps or wire loops are connected to a source of electrical power. One of the drawbacks of festoon style bulbs is their service life. Because replacing festoon style bulbs incurs maintenance costs there is a need in the art to reduce the maintenance cost of replacing festoon style bulbs with a source of light having a longer service life.

One of the alternative sources of light having a longer service life which has recently become available is the light emitting diode or LED. LED's have a longer service life and use less electrical power than prior art festoon style bulbs. To make LED's more usable as sources of light, several companies have developed a set of electrical componentry which is combinable with one or more LEDs and will transform the characteristics of existing available electrical power into electrical power useable by the one or more LEDs to emit light energy. However, there has been no system and method for mounting the combination of the one or more LEDs together with the electrical componentry into a commonly used AC powered light fixture.

SUMMARY

The present invention provides a system and method for mounting a combination of one or more LEDs and like supporting electrical componentry into a commonly used AC powered light fixture designed for the mounting of prior art festoon style bulbs.

The mounting system and method of the present invention for a combination of one or more LEDs and the supporting electrical componentry for transforming electrical energy received from an existing available electrical power source into electrical energy usable by the one or more LEDs to cause the one or more LEDs to emit light energy includes a LED light source support structure. The LED light source support structure positions the combination of the one or more LEDS and the supporting electrical componentry near the electrical power source. Further included in the LED light source support structure is a mounting for at least one pair of electrical contacts for conducting electrical power from the existing available electrical power source to the supporting electrical componentry. Also included within the LED light source support structure is a heat sink which conducts heat energy away from the one or more LEDs.

Alternatively, a lens may be mounted to the LED light source support structure for modifying the light rays emitted by the one or more LEDs.

In another embodiment individual LED light source support structures are made rotatably connectable, one with another, using an LED light source support structure connector.

BRIEF DESCRIPTION OF THE DRAWING FIGURES

A still better understanding of the LED light source mounting system and method of the present invention may be had by reference to the drawing figures, wherein.

DESCRIPTION OF THE EMBODIMENTS

As previously indicated the present invention is described with regard to its use with a lighting assembly including provisions for mounting a festoon style bulb 101. However, those of ordinary skill in the art will understand that the present invention also has applicability to other lighting assemblies using other styles of bulbs.

Figure 1:
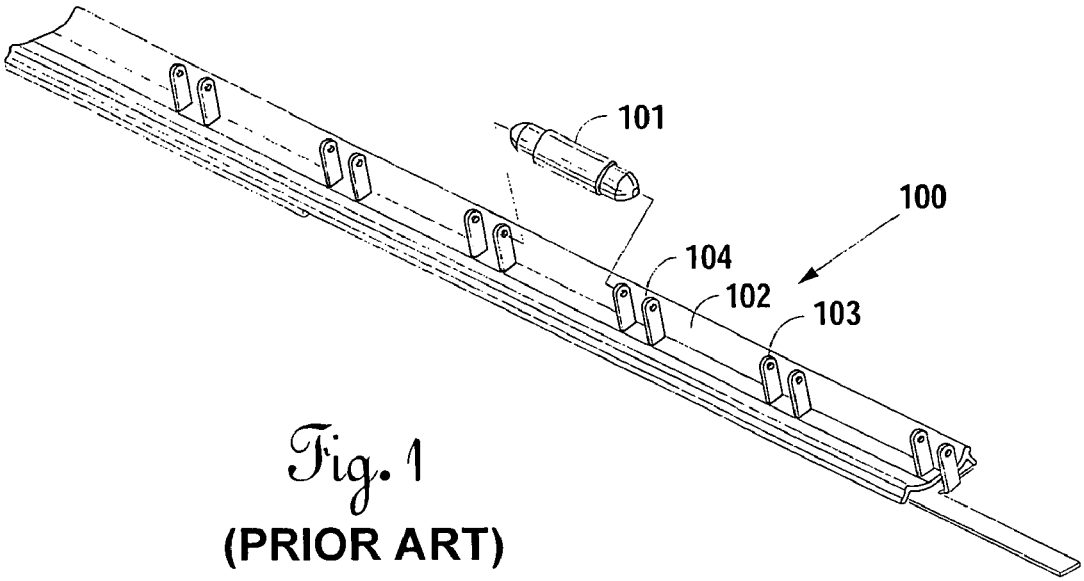
Fig. 1 (PRIOR ART)
FIG. 1 is a perspective view of a prior art linearly oriented mounting strip typically used for mounting a series of prior art festoon style bulbs (a prior art festoon style bulb is shown enlarged thereabove)

As may be seen in FIG. 1 the prior art lighting assembly 100 made for use with a festoon style bulb 101 includes a linearly oriented base strip 102. Extending through the base strip 102 are a plurality of connectors 103, 104. It is through the connectors 103, 104 that electrical energy is conveyed to a festoon style bulb 101 positioned between the connectors 103, 104. The flexible nature of the connectors 103, 104 provides for the retention of a festoon style lamp 101 therebetween. Other styles of connectors such as U-shaped receptacles and clips for attachment of wire loops may also be found on prior art base strips 102.

Because of the desire to use LEDs in the prior art lighting assembly shown in FIG. 1 a need has developed for a mounting system and method which will allow a light source which is a combination of one or more LEDs and supporting electrical componentry to be placed between connectors on a base strip 102 such as connectors 103, 104 shown in FIG. 1. This combination of one or more LEDs and the supporting electrical componentry which causes the LEDs to illuminator forms an LED light source assembly.

Figure 2:
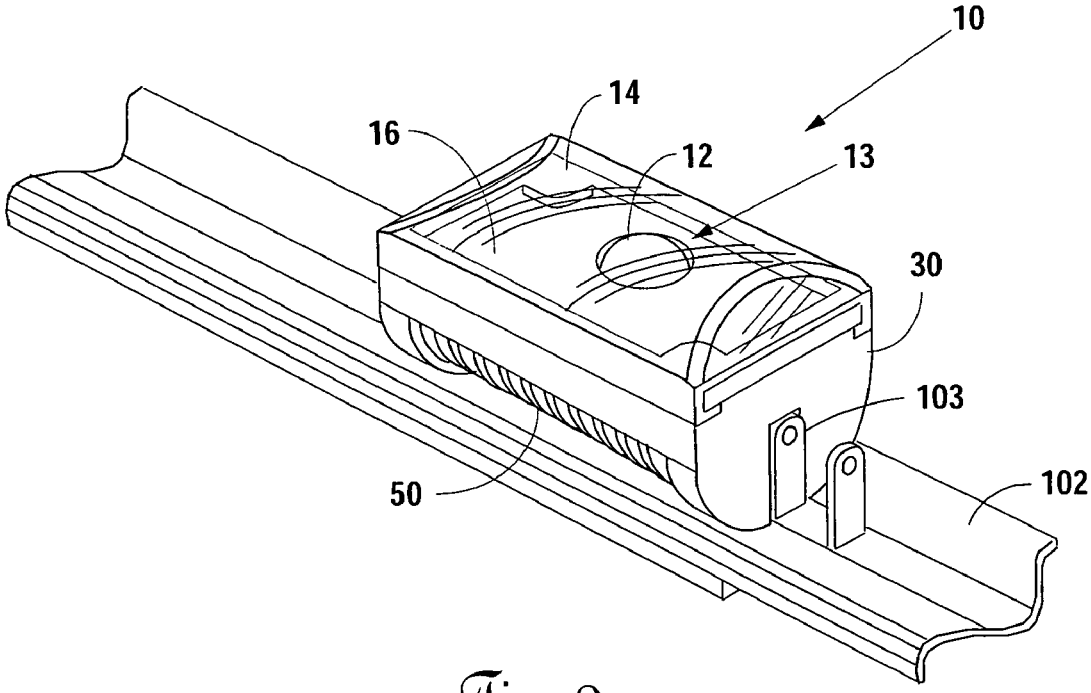
FIG. 2 is a perspective view of the LED light source mounting system of the present invention installed in a prior art linearly oriented mounting strip.

The mounting system 10 for the combination of the one or more LEDs 12 and the supporting electrical componentry 14 for supplying electrical energy to the one or more LEDs 12 in the LED light source assembly 13 is shown in FIG. 2. Included are the one or more LEDs 12 positioned in the central portion of a small circuit board 16 on which the supporting electrical componentry 14 is arranged, mounted and connected. While a circular array of the one or more LEDs 12 is shown, those of ordinary skill in the art will realize that other arrays of the one or more LEDs 12, such as a linear or an arcuate array, may be used without departing from the scope of the present invention. It is the supporting electrical componentry 14 on the small circuit board 16 which enables the one or more LEDS to utilize existing available AC or DC electrical power such as 120V, 12V or 24V to transform the existing available electrical power into either rapidly pulsating DC or the type of DC usable by the one or more LEDS 12 to emit light energy. In actual practice the electrical componentry 14 mounted to the small circuit board on 16 uses a technique known as capacitive coupling; however other techniques or transforming available electrical power into a condition that is usable by the one or more LEDs to emit light energy may be used.

According to the present invention a mounting system and method 10 is provided which performs three essential functions. First, support is provided for the LED light source assembly 13. Second, provision is made for connecting the supporting electrical componentry 14 to connectors which supply electrical power. And, third, a heat sink 50 is provided for managing the heat energy developed by the one or more LEDs 12. Each of these three functions will be explained in greater detail below.

Figure 3:
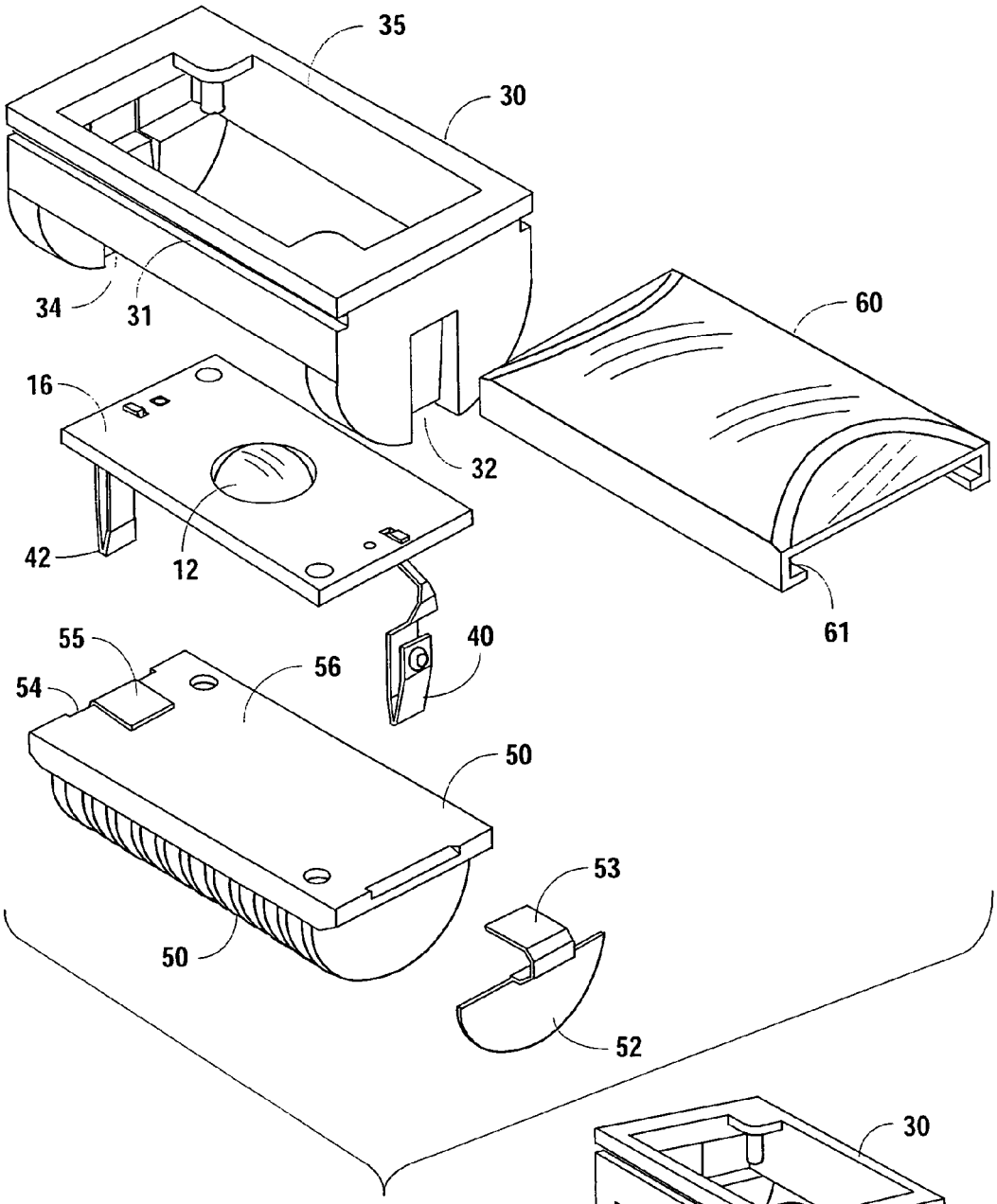
FIG. 3 is an exploded perspective view of the LED light source mounting system of the present invention.

As shown in FIG. 3 an LED light source support structure 30 is formed to include an opening 35 into which the small circuit board 16 fits. This LED light source support structure 30 both mounts and positions the LED light source assembly 13. The remaining portions of the mounting system and method of the present invention are built around the foundation provided by the LED light source support structure 30.

As may be further seen by reference to FIG. 3 a pair of slide-fit type electrical contacts 40, 42 have been connected to the electrical componentry 14 residing on the small circuit board 16. While slide-fit type contacts 40, 42 are used in the preferred embodiment to engage connectors of the type shown in FIG. 1, those of ordinary skill in the art will understand that a variety of different type electrical contacts may be used to effection connection to the small circuit board 16 without departing from the scope of the present invention. The two slide-fit type electrical contacts 40, 42 are sized and positioned to pass through and are positioned by openings 32, 34 on either end of the light source support structure 30. Contacts other than slide-fit type electrical contacts may be used by changing the size and configuration of openings 32, 34. Such other contacts will enable use of the mounting system to of the present invention with U-shaped receptacles or clips designed for the attachment of wire Loops Underneath the small circuit board 16, but within the LED light source support structure 30, is a heat sink 50. Shown in the preferred embodiment is a finned heat sink 50 which uses the flow of ambient air past fins 52 for the transfer of heat energy generated by the one or more LEDs 12 through the heat sink 50 to disperse the heat energy to the ambient air. While a finned heat sink 50 is shown in the preferred embodiment other types of heat sinks, either air cooled or cooled by some other medium well know to those of ordinary skill in the art, may be used. If desired, the heat sink 50 and small circuit board 16 may be formed from a thermally conductive polymer.

Separating the electrical connectors 40, 42 from the finned heat sink 50 are a pair of insulator end pieces 52, 54. The insulator end pieces 52, 54 are positioned at either end of the heat sink 50. In addition to providing a pathway for the heat energy generated by the one or more LEDs the top 56 of the heat sink 50 provides a surface on which the tabs 53, 55 extending from the insulator end pieces may rest to hold the insulator end pieces 52, 54 in position with respect to the openings 32, 34 formed on either end of the LED light source support structure 30.

Figure 3A:
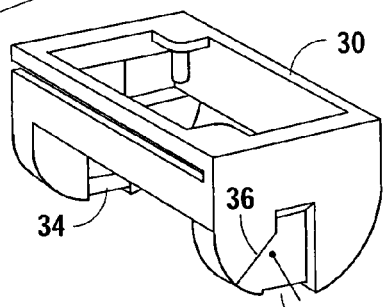
FIG. 3A is a perspective of an alternate embodiment of the LED light source support structure enabling rotation of the LED light source support structure within a pair of electrical contacts.

As may be seen in FIG. 3A, the openings 32, 34 may be formed to include an angled side 36. This angled side 36 allows the LED light source support structure 30 to be rotated with respect to the connectors extending upwardly from base strip 102. It is by this rotation of the LED light source support structure 30 that the light rays from the one or more LEDs 12 may be re-directed into an orientation other than orthogonal to the linearly oriented base strip 102. Those of ordinary skill in the art will understand that mechanical stops or detents may be used to lock the LED light source support structure 30 in various angular orientations with respect to the base strip 102.

Optionally, and as shown in FIG. 3, attached to the top of the light source support structure 30 is a lens assembly 60. The lens assembly 60 is both sized and positioned to intercept and modify the characteristics of the light rays emitted from the one or more LEDs 12. Shown in the preferred embodiment is a pillow shaped lens with soft curves. The lens assembly 60 is mounted to the light source support structure 30 by a tongue 61 and groove 31 connection. The lens itself may be selected from a variety of available lenses for coloration, redirection or reduction of the light intensity emitted by the one or more LEDs 12. The use of such a lens assembly 60 will also permit the user to cause the light emitted from the one or more LEDs 12 to be directed to just one side of the base strip 102 or symmetrically with respect to the base strip 102 as desired.

Thus, according to the present invention, a prior art festoon style lamp 101 may be replaced by a LED light source assembly 13 when placed within the mounting system 10 of the present invention. This replacement of a prior art festoon style bulb 101 is accomplished by first removing the prior art festoon style bulb 101 from the lighting fixture 102 in which it is mounted. The prior art festoon style bulb 101 is then replaced with the structure depicted by reference to FIGS. 2 and 3. Specifically, a LED light source assembly 13 including one or more LEDs 12 and supporting electrical componentry 14 is positioned within the light source support structure 30. Electrical contacts 40, 42 for providing electrical power to the LED light source assembly 13 are positioned within openings 32, 34 at either end of the LED light source support structure 30. A heat sink 50 is then put in place underneath the LED light source support structure 30 for conducting heat energy away from the LED light source assembly 13. The structure as depicted in FIGS. 2 and 3 is then put in the place of the prior art incandescent festoon style light source 101 within the light fixture 102.

Users may elect to only replace prior art festoon style bulbs with the structure depicted in FIGS. 2 and 3 as the prior art festoon style bulbs burn out or alternatively users may mix the structure depicted in FIGS. 2 and 3 with prior art festoon bulbs to achieve lighting effects only available by using LEDs.

Figure 4A:
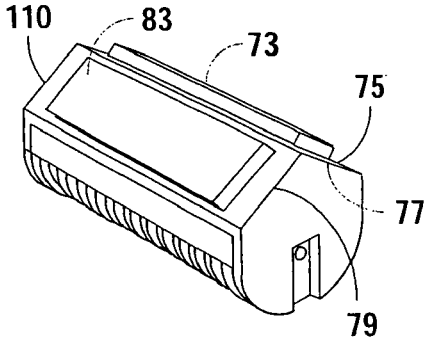
FIG. 4A is a perspective view of an alternate embodiment of the LED light source mounting system of the present invention including two sets of LEDs and supporting electrical componentry positioned on a surface having two intersecting planes.
Figure 4B:
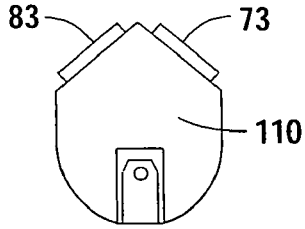
FIG. 4B is a cross sectional view of the embodiment shown in FIG. 4A.

Shown in FIGS. 4A and 4B is an alternate embodiment 110 of the LED light source mounting system of the present invention. Instead of a single LED light source assembly 13 including one or more LEDs 12, and supporting electrical componentry 14, mounted within the LED light source support structure 30 are multiple LED light source assemblies 73, 83. To expand the pattern of light energy emitted from the light source assemblies 73, 83, the light source assemblies 73, 83, have been positioned on a mounting surface 75 including two or more intersecting planes 77, 79.

Figure 4C:
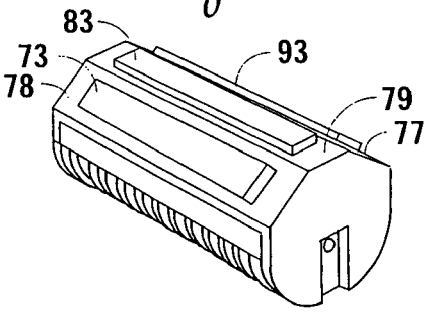
FIG. 4C is a perspective view of an alternate embodiment of the LED light source mounting system of the present invention including three sets of LEDs and supporting electrical componentry positioned on a surface having three intersecting planes.
Figure 4D:
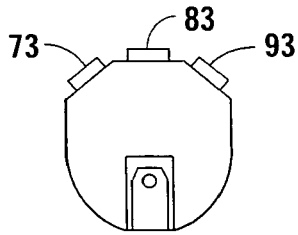
FIG. 4D is a cross sectional view of the embodiment shown in FIG. 4C.
Figure 4E:
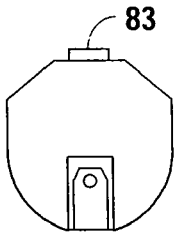
FIG. 4E is a cross sectional view of the embodiment shown in FIG. 4C but with only a single set of LEDs and supporting electrical componentry on a substantially horizontal planar surface.
Figure 4F:
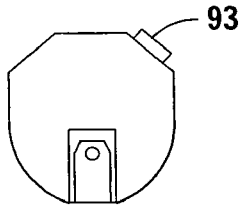
FIG. 4F is a cross sectional view of the embodiment shown in FIG. 4C but with only a single set of LEDs and supporting electrical componentry on a substatially angled planar surface.
Figure 4G:
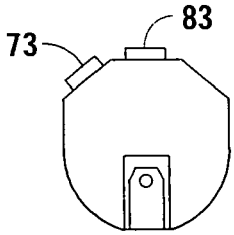
FIG. 4G is a cross sectional view of the embodiment shown in FIG. 4C but with two sets of LEDs and supporting electrical componentry on adjacent planar surfaces.
Figure 4H:
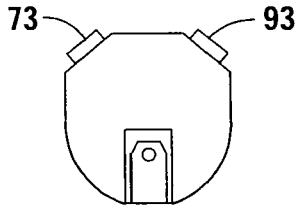
FIG. 4H is a cross sectional view of the embodiment shown in FIG. 4C but with two sets of LEDs and supporting electrical componentry on separated substantially angled planar surfaces.

Shown in FIGS. 4C and 4D is an embodiment including three substantially planar surfaces 77, 78, 79. Such structure enables the use of three LED light source assemblies 73, 83, 93. Those of ordinary skill in the art will understand that if only one or two LED light source assemblies are used other configurations are possible such as those depicted in FIGS. 4E, 4F, 4G and 4H.

Figure 5:
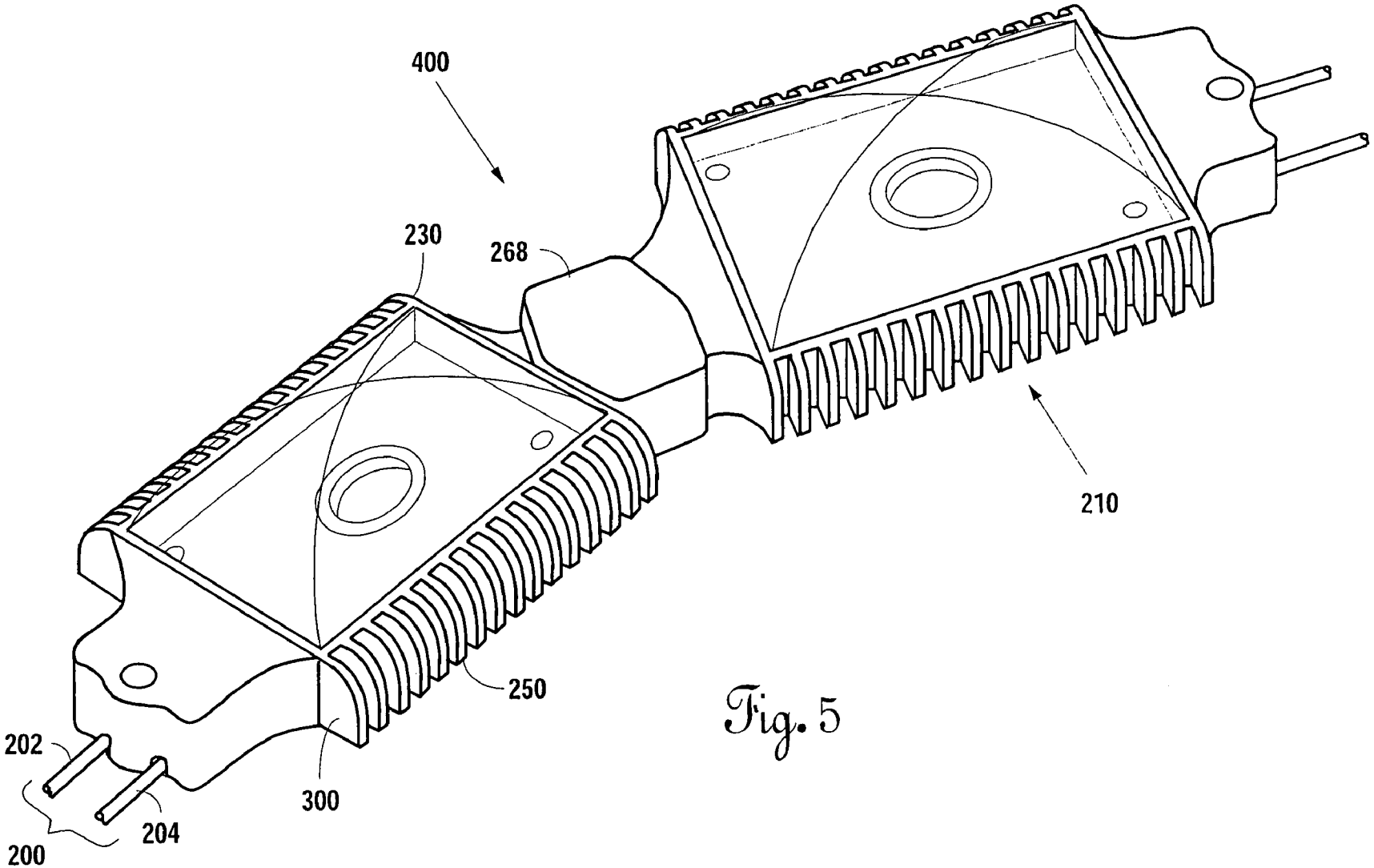
FIG. 5 is a perspective view of multiple LED light source support structures rotatably connected one to another using an LED light source support structure connector.
Figure 6:
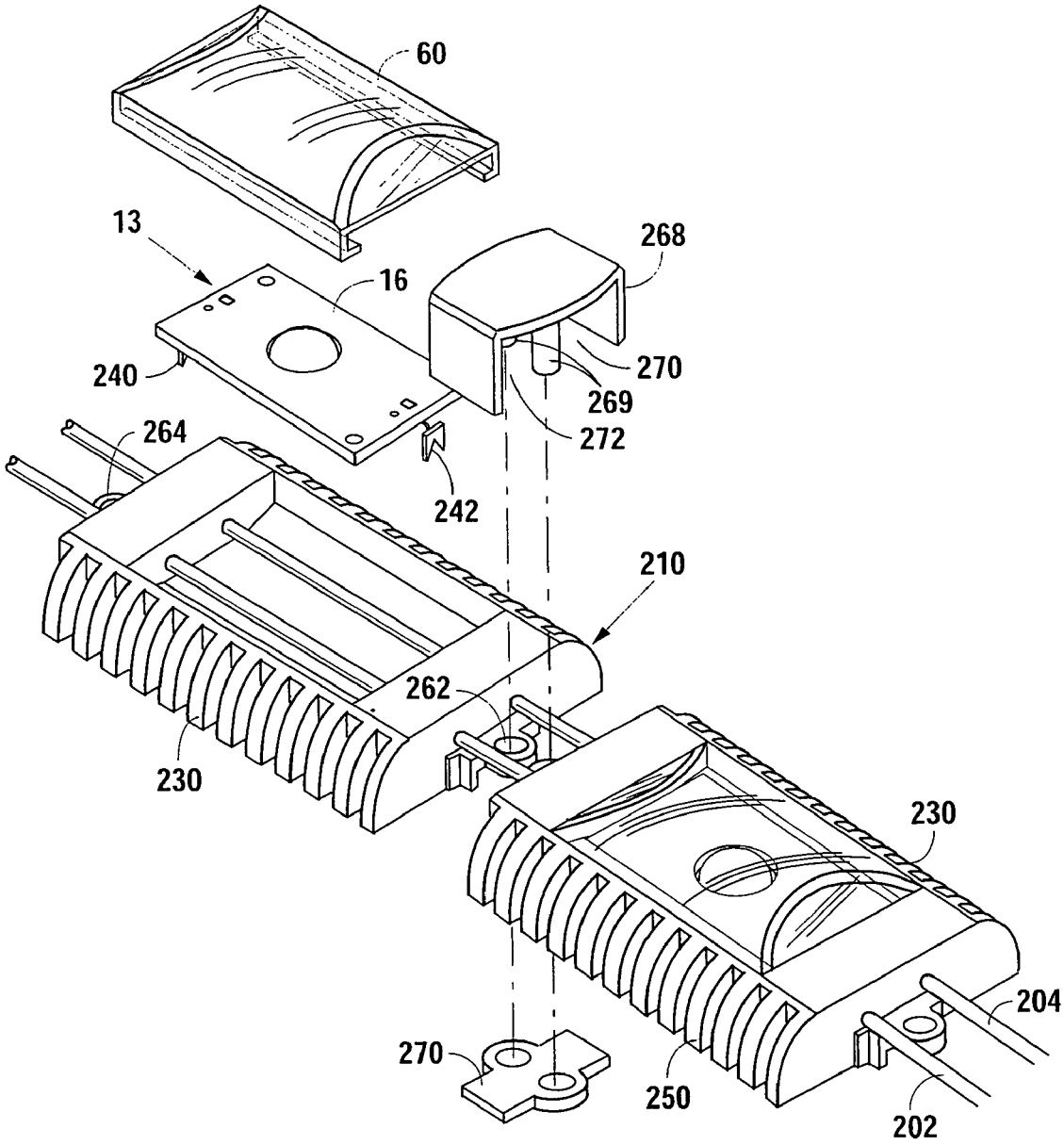
FIG. 6 is a an exploded perspective view of the LED light source support structure and LED light source support structure connector shown in FIG. 5.

Shown in FIGS. 5 and 6 is another embodiment of the LED light source assembly mounting system and method of the present invention 210 particularly adapted for use with a two wire electrical power source 200. The two wires in the two wire electrical power source 202, 204 pass through LED light source assembly support structure 230. The connectors 240, 242 at either end of the small circuit board 16 are sharpened to pierce the insulation surrounding the wires 202, 204.

Further included in the LED light source support structure 230 are rotatable mechanical connections 262, 264 located on each end. The rotatable mechanical connections 262, 264 are openings sized to engage pins 269 located within light source support structure connector 268. When pins 269 have passed through openings 262, 264, adjacent light source support structures 230 are hingedly connected one to another. A keeper 270 on the bottom of the pins 269 may be used for securing the hinged connection. The two wires 202, 204 in the two wire electrical power source 200 pass through spaces 270, 272 in the LED light source support structure connector 268. Accordingly, a series of light source support structures 230 may be rotatably connected one to another with LED light source support connectors 268 positioned therebetween.

Those of ordinary skill in the art will understand that LED light source support connectors 268 may be short as shown in FIGS. 5 and 6 or they may have an extended length for separating the LED light source supports 230 at a distance one from another. By the use of a flexible material such as plastic for both the LED light source support structure 230 and the LED light source support structure connector 268, the LED light source support structures 230 and the LED light sources support connectors 268 may be easily put together for assembly into a long straight or formable string. The result is a formable fixture 300 made from a string of LED light source support structures 230 and LED light source support structure connectors 268 which may be used for both the mounting of a plurality of LED light source assemblies 13 and forming into one or more substantially arcuate shapes. When a plurality of LED light source assemblies 13 are mounted in the formable fixture 300, the combination becomes a formable light assembly 400.

As further shown in FIG. 6, one or more heat sinks 250 are positioned next to each light source support structure 230 for removing heat energy generated by the light source.

Figure 7:
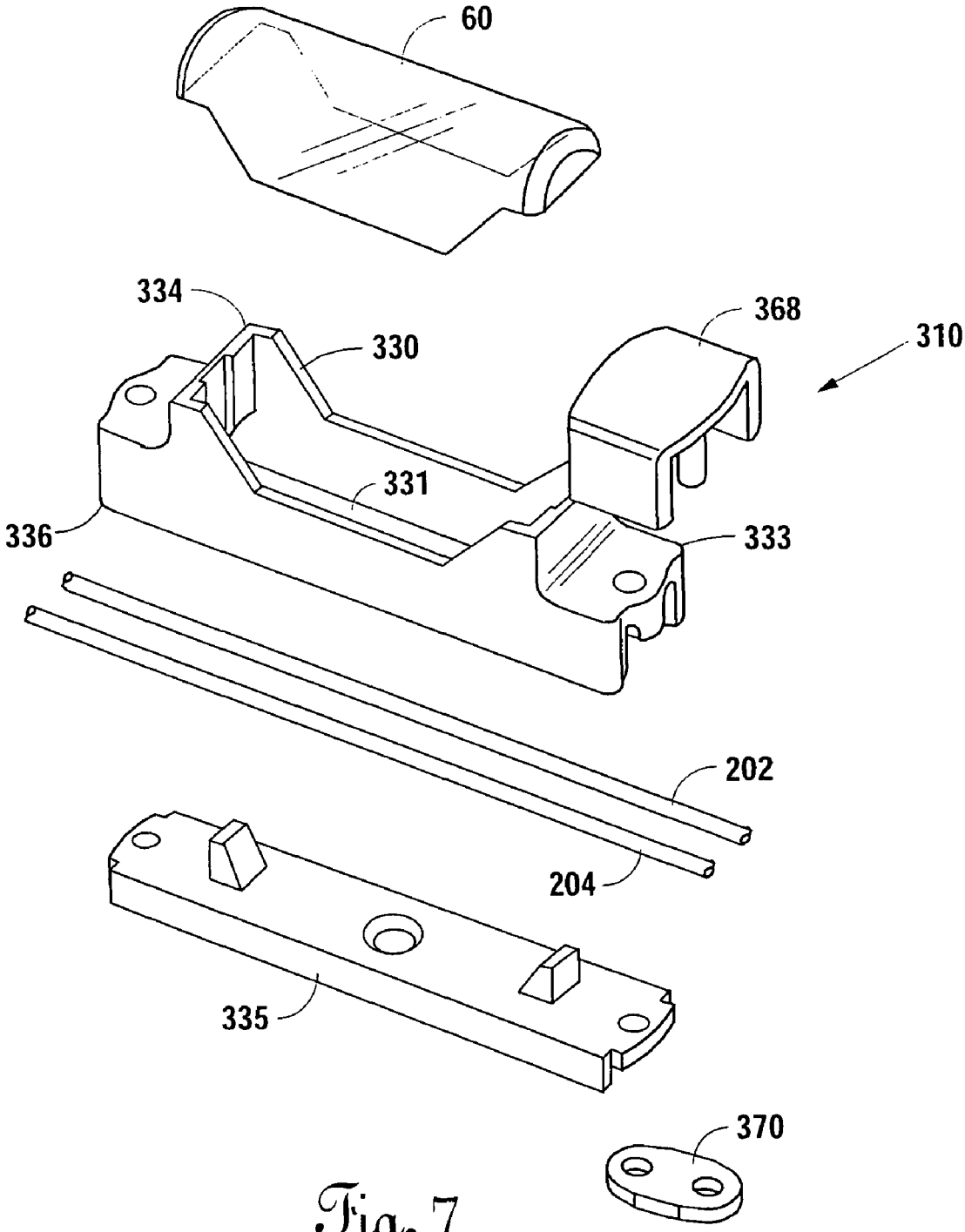
FIG. 7 is an exploded perspective view of an LED light source support structure for use with a self cooling light source.

By reference to FIG. 7 it may be seen that the system disclosed in FIGS. 5 and 6 may also be used with self-cooling light sources. In this embodiment 310 the light source support structure 330 has a two portions, 333, 335. The upper portion 333 has a top side 334 similar to the light source support structure 30 described in FIGS. 2 and 3 for positioning a self-cooling light source and any required supporting electrical componentry. On the bottom side 336 of the upper portion 333 of the light source support structure 330 is an opening providing room for any electrical contact needed to make electrical contact with wires 202, 204.

The lower portion 335 of the light source support structure 330 is sized to fit within the open space 331 on the bottom side of the upper portion 333 of the light source support structure 330. When in position the lower portion 335 of the light source structure 330 may be used for securing an electrical contact with wires 202, 204. The rotatable connection between adjacent light source support structures 330 is the same as described in FIGS. 5 and 6 away from the light source.

While the light source mounting system and method of the present invention has been described above according to its preferred and alternate embodiments, those of ordinary skill in the art will understand that numerous other embodiments have been enabled. Such other embodiments shall be included within the scope and meaning of the appended claims.

What is claimed is:

1. A formable lighting fixture for LED light source assemblies usable with a two wire electrical power source, said formable lighting fixture comprising:

a plurality of LED light source support structures;

a plurality of LED light source support structure connectors positioned between said LED light source support structures;

each of said LED light source support structures including a portion constructed and arranged for positioning an LED light source assembly therein;

said LED light source support structure including a mounting for at least a pair of electrical contacts, said electrical contacts having a first end for making electrical contact with the LED light source assembly and a second end for making electrical contact with one of the two wires in the two wire electrical power source;

a mechanical mounting for rotatable connection with said LED light source support structure connector positioned on either end of said LED light source support structure;

said LED light source support structure connector including a plurality of spaces for passage of said two wire electrical power source therethrough;

said LED light source support structure connector further including a mechanical mounting constructed and arranged for rotatable interfitment with said mechanical mounting of said LED light source support structure;

whereby a plurality of LED light source support structures may be rotatably and mechanically connected one to another by said LED light support structure connectors while maintaining contact with said two wire electrical power source.

2. A formable light assembly usable with a two wire electrical power source comprising:

a plurality of LED light source assemblies, each of said LED light source assemblies including one or more LEDs and supporting electrical componentry for transforming electrical energy received from the two wire electrical power source into electrical energy usable by said one or more LEDs to cause said one or more LEDs to emit light energy;

a plurality of LED light source support structures for mounting one of said plurality of LED light source assemblies;

a plurality of LED light source support structure connectors positioned between said LED light source support structures;

each of said LED light source assembly support structures including a portion constructed and arranged for positioning an LED light source assembly therein;

said LED light source support structure including a mounting for at least a pair of electrical contacts for making electrical contact between said LED light source assembly and one of the two wires in the two wire electrical power source;

a mechanical mounting for rotatable connection with said LED light source support structure connector formed on either end of said LED light source support structure;

said LED light source support structure connector including a plurality of openings for passage of said two wire electrical power source therethrough;

said LED light source support structure connector further including a pair of mechanical mountings constructed and arranged for rotatable interfitment with said mechanical mounting of said LED light source support structure;

whereby a plurality of LED light source support structures may be rotatably and mechanically connected one to another by said LED light source support structure connectors while maintaining contact with said two wire electrical power source.

3. A formable lighting fixture for self-cooling light sources usable with a two wire electrical power source, said formable lighting fixture for self-cooling light sources comprising:

a plurality of light source support structures;

a plurality of light source support structure connectors positioned between said light source support structures;

each of said light source support structures including an upper portion with a top side, said top side being constructed and arranged for positioning a self-cooling light source therein;

said upper portion of said light source support structure providing room for at least a pair of electrical contacts for making contact with one the two wires in the two wire electrical power source on the bottom side of said upper portion of the light source support structure;

a lower portion of said light source support structure constructed and arranged for interfitment into said bottom side of said upper portion of said light source support structure;

a mechanical mounting for rotatable connection with said light source support structure connector positioned on either end of said light source support structure;

said light source support structure connector including a plurality of openings for passage of said two wire electrical power source therethrough;

said light source support structure connector further including a mechanical mounting constructed and arranged for rotatable interfitment with said mechanical mounting of said light source support structure;

whereby a plurality of light source support structures may be rotatably and mechanically interconnected one to another by said light source support structure connectors while maintaining contact with said two wire electrical power source.

* * * * *

UNITED STATES PATENT AND TRADEMARK OFFICE

CERTIFICATE OF CORRECTION

PATENT NO. : 7,819,551 B2
APPLICATION NO. : 12/008563
DATED : October 26, 2010
INVENTOR(S) : Pat Ward It is certified that error appears in the above-identified patent and that said Letters Patent is hereby corrected as shown below:

Title page, Item (73) Assignee: please change the spelling of Assignee's name to Lucifer Lighting Company Signed and Sealed this
Twenty-eighth Day of December, 2010

David J. Kappos

David J. Kappos
*Director of the United States Patent and Trademark Office*